United States Patent [19]

Kölbel et al.

[11] Patent Number: 4,773,640

[45] Date of Patent: Sep. 27, 1988

[54] DUMBBELL TYPE EXERCISING DEVICE

[76] Inventors: Gert F. Kölbel; Renate G. Perleberg-Kölbel, both of Hanebuthwinkel 15, D-3000 Hannover 51, Fed. Rep. of Germany

[21] Appl. No.: 27,349

[22] Filed: Mar. 18, 1987

[30] Foreign Application Priority Data

Mar. 29, 1986 [DE] Fed. Rep. of Germany ..... 3610622

[51] Int. Cl.[4] ..... A63B 11/00

[52] U.S. Cl. ..... 272/122

[58] Field of Search ..... 272/117, 119, 122, 123, 272/124, 128, 143, 132

[56] References Cited

U.S. PATENT DOCUMENTS

| | | | |
|---|---|---|---|
| 990,791 | 4/1911 | Whitley et al. . | |
| 1,333,005 | 3/1920 | Warner | 272/128 |
| 1,672,944 | 6/1928 | Jowett . | |
| 3,572,702 | 3/1971 | Dorn | 272/123 |
| 4,029,312 | 6/1977 | Wright | 272/122 X |
| 4,076,236 | 2/1978 | Tonel | 272/123 |
| 4,089,528 | 5/1978 | Green | 272/122 |
| 4,218,057 | 8/1980 | Wilson | 272/117 |
| 4,361,324 | 11/1982 | Barol | 272/122 X |
| 4,461,473 | 7/1984 | Cole | 272/123 |
| 4,566,690 | 1/1986 | Schook | 272/122 X |
| 4,618,143 | 10/1986 | Twaroosz | 272/123 |
| 4,690,400 | 9/1987 | Metz | 272/143 X |

FOREIGN PATENT DOCUMENTS 3211825 10/1983 Fed. Rep. of Germany ..... 272/122

*Primary Examiner*—Richard J. Apley
*Assistant Examiner*—Robert W. Bahr
*Attorney, Agent, or Firm*—Peter K. Kontler

[57] ABSTRACT

A dumbbell type exercising device wherein two hollow weights are integrally connected to each other by a flat coupling member having a centrally located opening for a metallic ring which surrounds a diametrically extending handle. The ring can rotate with the handle relative to the coupling member and/or the handle can be turned within the confines of the ring. Removable screw caps which afford access to the interior of the weights can be used as handgrip elements, and the weights can receive selected quantities of water, sand and/or fragmentized metallic materials to determine the overall weight of the exercising device. The handle or the handle and the ring can be engaged by a hand or by a foot of the user.

13 Claims, 5 Drawing Sheets

DUMBBELL TYPE EXERCISING DEVICE

BACKGROUND OF THE INVENTION

The present invention relates to exercising devices in general, and more particularly to improvements in dumbbell type exercising devices (also known as hantels or bar-bells) wherein spaced-apart weights are connected to each other by a coupling member.

It is known to construct the coupling member between the weights of a dumbbell in such a way that the device can be manipulated by one hand. In many instances, the coupling member is a bar the end portions of which carry weights in the form of solid discs, hollow bodies or the like. A hollow body can receive a supply of filler material to increase the mass of the respective weight.

U.S. Pat. No. 990,791 discloses a bar-bell wherein a rod-shaped manually engageable coupling member carries two hollow spherical weights each having an opening which is sealable by a cap.

U.S. Pat. No. 1,672,944 discloses a dumbbell with a hand gripping portion (coupling member) which is disposed between two sets of disc-shaped weights, and a specific mode of separably mounting the weights on the gripping portion.

U.S. Pat. No. 4,029,312 discloses an exercising device wherein a bar- or rod-shaped coupling member carries two egg-shaped weights each of which has an aperture for insertion of a hand thereinto. The patent further discloses the possibility of shifting the weights toward each other so as to expose the end portions of the coupling member and enable the user to grasp the device with two hands, i.e., each hand can engage a different end portion of the rod. Still further, the patentee proposes to detach one or both weights and to use the detached weights as discrete exercising devices each of which is to be manipulated by a different hand of the user.

U.S. Pat. No. 4,076,236 discloses a bar-bell type exercising device which is analogous to that described in U.S. Pat. No. 990,791, i.e., a bar or a rod is used as a coupling member for one, two or more pairs of hollow weights which can receive suitable filler materials.

German Offenlegungsschrift No. 29 15 615 discloses a dumbbell which is to be manipulated by one hand and includes a hollow coupling member between two hollow weights. The weights are integral with the coupling member, and the device further comprises two additional or auxiliary handles one of which is a removable cap serving to expose an opening for admission of a filler material into the respective weight. Each of the weights has a substantially elliptical shape which is considered desirable and advantageous in connection with the carrying out of certain types of exercises. The configuration of the coupling member between the weights conforms to the hand which is to be used to lift and otherwise manipulate the device. The handgrip portion of the coupling member is kept in a predetermined orientation with reference to the elliptical weights.

German Utility Model No. 19 38 533 discloses an exercising device with hollow weights. The coupling member between the weights is hollow, the same as in the device of German Offenlegungsschrift No. 29 15 615, and is integral with the weights. The Utility Model further discloses disc-shaped weights which can be moved longitudinally of the handgrip member.

German Offenlegungsschrift No. 26 01 524 discloses a handle or coupling member which carries separable weights, and the weights carry means for facilitating the attachment of additional weights thereto.

The filler material suggested by inventors named in those of the aforediscussed prior publications which disclose hollow weights and coupling members includes water, sand, spheres of lead and fragments of other metallic material.

OBJECTS AND SUMMARY OF THE INVENTION

An object of the invention is to provide a dumbbell type exercising device whose versatility is greater than that of the aforediscussed and other conventional exercising devices.

Another object of the invention is to provide a device which can be used for the exercising of practically any desired part of the body, which can be manipulated by one hand, by both hands or by a foot, and wherein the handle automatically assumes or can be caused to assume an optimum orientation with reference to the weights.

A further object of the invention is to provide the exercising device with novel and improved means for facilitating manipulation by a hand or a foot.

An additional object of the invention is to provide a device which can be used with advantage by adolescents, adults and senior citizens of both sexes and which can be employed to carry out a wide variety of exercising programs without any or with a minimum of adjustment.

Still another object of the invention is to provide the exercising device with novel and improved coupling means for the weights.

A further object of the invention is to provide an exercising device which can be produced at a reasonable cost, which comprises a small number of simple parts, whose weight can be altered by resorting to readily available cost-free or very inexpensive materials, and which can be adjusted by using simple tools such as screwdrivers and the like.

Another object of the invention is to provide a novel and improved method of utilizing the above outlined exercising device.

An additional object of the invention is to provide an exercising device wherein certain parts perform plural functions so as to contribute to simplicity and lower initial cost.

A further object of the invention is to provide a device for the exercising of muscles which cannot be exercised or cannot be exercised satisfactorily with conventional dumbbells and the like.

The invention resides in the provision of a dumbbell type exercising device which comprises two spaced-apart weights at least one of which is hollow, a preferably flat elongated coupling member which is disposed between and is connected to the weights, and a handle which is angularly movably installed in the coupling member, preferably substantially midway between the weights. The handle is preferably rotatable in the coupling member about an axis which extends transversely of the elongated coupling member.

An annular support can be provided in the coupling member to surround the handle. The handle can be provided with an uneven external surface to facilitate gripping by a hand of the user, and the handle is preferably disposed substantially diametrically of the annular support if the latter has a ring-shaped (circular) outline. The arrangement may be such that the handle is rigid with the annular support and the latter is rotatable in the coupling member, or that the handle is rotatable in the support and the latter is more or less rigidly connected to the coupling member.

The coupling member can be integral with the weights; for example, such coupling member and the weights can jointly constitute a blow molded one-piece article. If each of the weights is hollow and defines at least one chamber, the chambers of the two weights are or can be sealed from each other by the coupling member.

The annular support can be formed with a circumferential groove, and the coupling member can comprise a projection (e.g., a ring-shaped web or rib) which extends into the groove. In accordance with a presently preferred embodiment of the invention, the annular support comprises two mirror symmetrical annular sections and the aforementioned projection or web of the coupling member is disposed between the two annular sections. Such device preferably further comprises means (e.g., a set of externally threaded members in the form of screws, bolts or the like) for connecting the sections to each other so that the thus connected sections are in frictional engagement with the respective sides of the web. The connecting means is preferably adjustable (e.g., the force with which a set of for example four equidistant screws connects the sections to each other can be relaxed or increased) so as to change the extent of friction between the sections and the web. The arrangement may be such that the sections are rotatable relative to the coupling member in at least one position of adjustment of the connecting means but the sections are held against rotation relative to the web in at least one second position of adjustment of the connecting means.

Each hollow weight is further formed with an inlet-outlet opening which communicates with the respective chamber, and each such weight further comprises detachable means (e.g., an externally threaded bung, a screw cap or the like) for sealing the respective opening. Fillers (such as bodies of a liquid medium, sand, scraps of metal, balls of steel or other metallic material or combinations thereof) can be provided in the chambers to determine the masses of the respective weights.

The aforementioned detachable sealing means can constitute handgrip elements which can be grasped by the hands of the user if the device is to be manipulated by two hands rather than by a single hand or by a single foot which engages the handle. The arrangement is preferably such that each weight is disposed between the coupling member and the respective handgrip element.

At least one of the weights can comprise a skeleton frame of a metallic or plastic material and a plastic wall or skin which surrounds the frame.

The improved exercising device can be manipulated by one or two hands or by a foot.

The novel features which are considered as characteristic of the invention are set forth in particular in the appended claims. The improved exercising device itself, however, both as to its construction and the mode of assembling, dismantling and using the same, together with additional features and advantages thereof, will be best understood upon perusal of the following detailed description of certain presently preferred embodiments with reference to the accompanying drawing.

DESCRIPTION OF THE PREFERRED EMBODIMENTS

Figure 1:
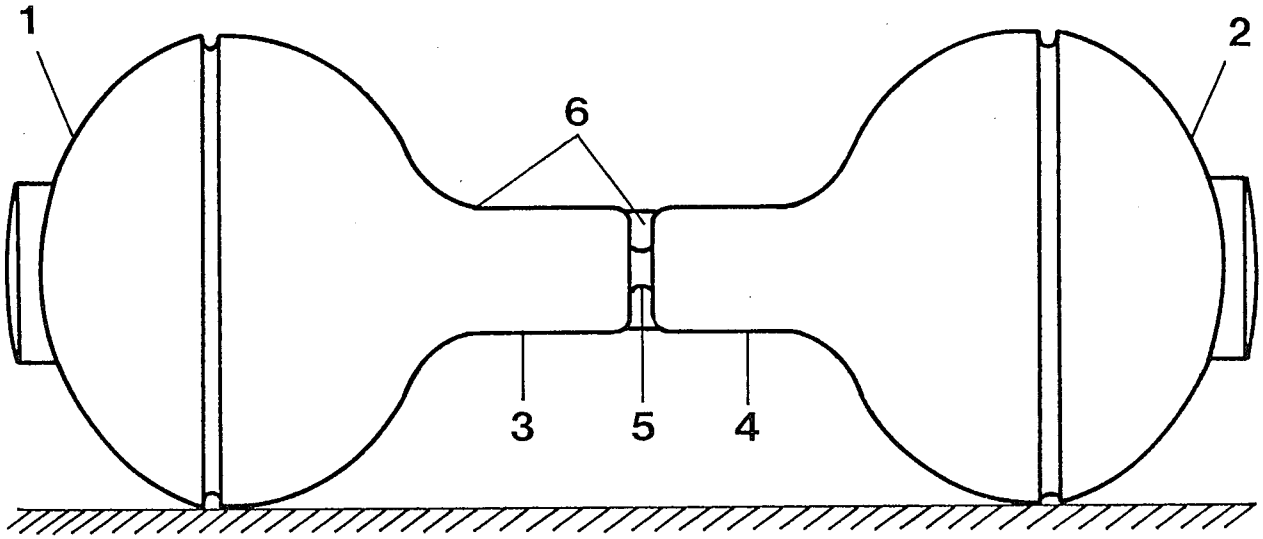
FIG. 1 is an elevational view of a dumbbell type exercising device which embodies one form of the invention.
Figure 2:
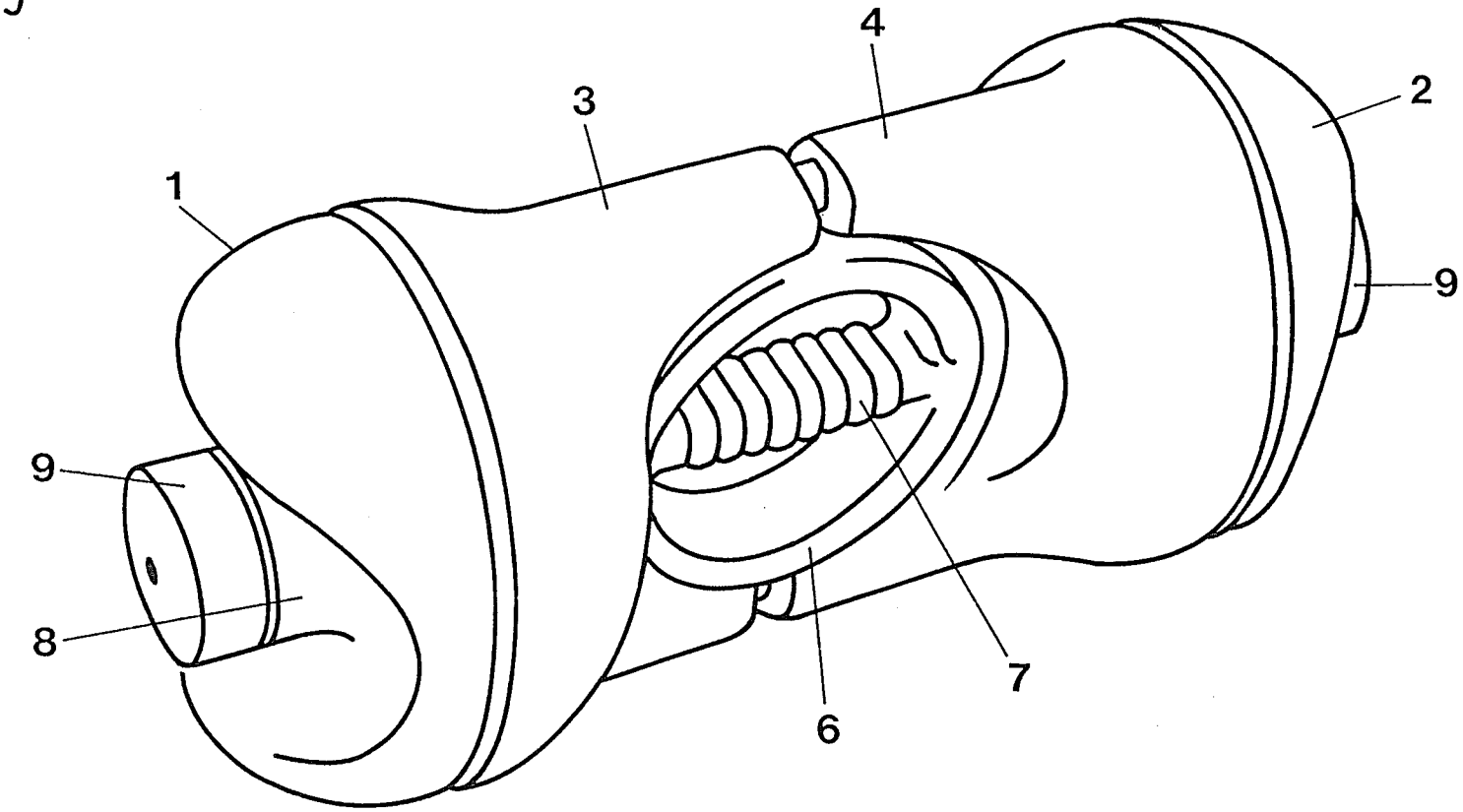
FIG. 2 is a first perspective view of the exercising device which is shown in FIG. 1.
Figure 3:
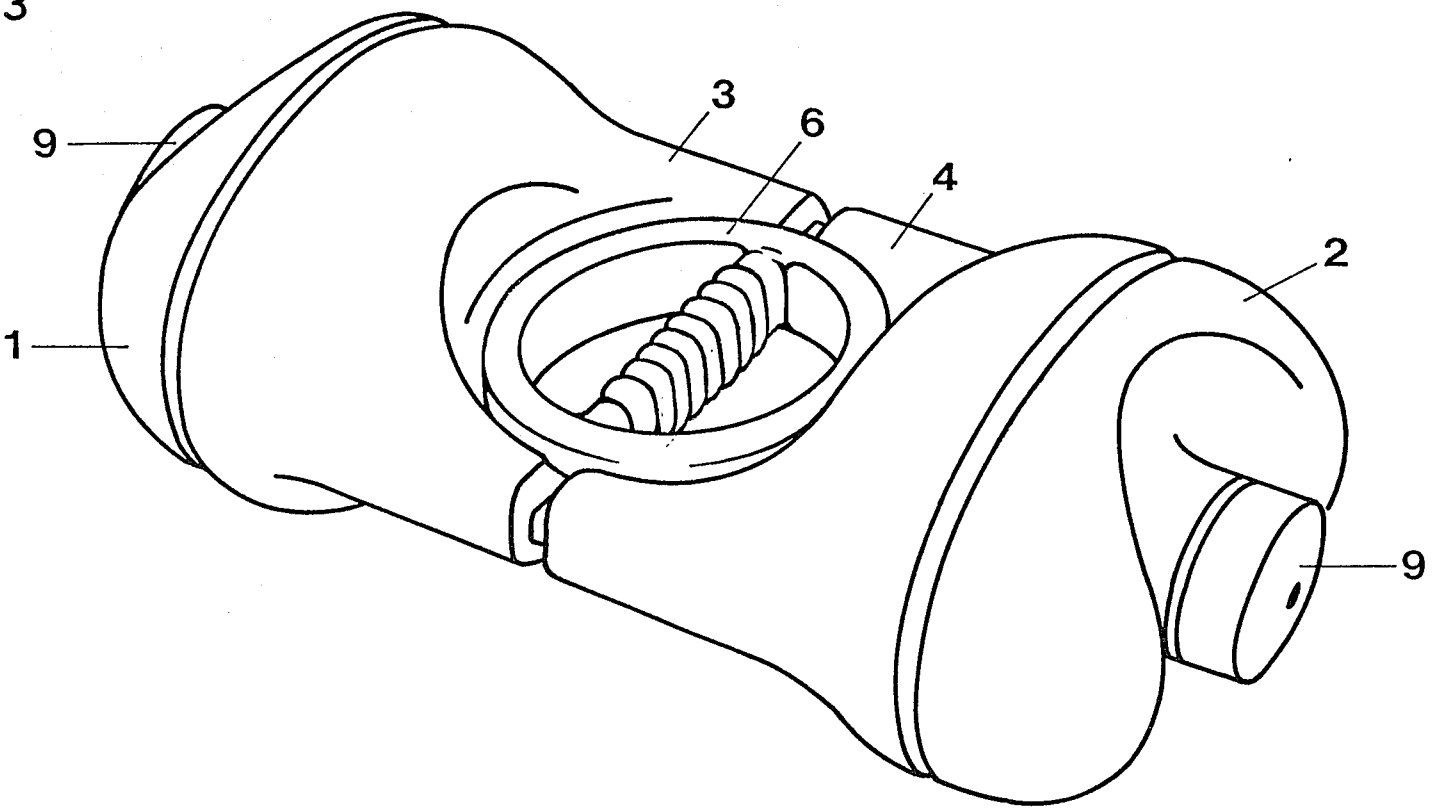
FIG. 3 is a different perspective view of the exercising device which is shown in FIG. 1.

The exercising device of FIGS. 1 to 4 comprises a one-piece part which is preferably formed in a blow molding machine and includes two spaced-apart hollow weights 1, 2 and a flat coupling member including two coplanar portions 3, 4 which are respectively integral with the weights 1, 2 and a rigid rib or web 5 which connects the portions 3, 4 to each other and defines a substantially circular opening preferably midway between the weights 1 and 2. This can be readily seen in FIGS. 2 and 3. The opening can be cut into the coupling member by removing the major part of the web 5, and such opening receives an annular metallic support 6 for a metallic or plastic handle 7 which extends diametrically of and is surrounded by the support 6. The illustrated support 6 is a ring which comprises two mirror symmetrical annular sections *6a* and *6b* (see FIG. 4). The web 5 includes an annular projection *5a* (FIG. 4) which extends into a circumferential groove *6c* defined by the sections *6a, 6b*. Connecting means 10 in the form of screws, bolts or similar threaded fasteners are provided to separably connect the sections *6a* and *6b* to each other. The connecting means 10 are adjustable, i.e., their clamping force upon the sections *6a* and *6b* can be altered so as to enable an operator to change the angular position of the support 6 with reference to the coupling member 3–5 by loosening the screws, and to enable the operator to thereupon tighten the screws so as to hold the sections *6a,6b* against any angular displacement relative to the web 5.

Figure 4:
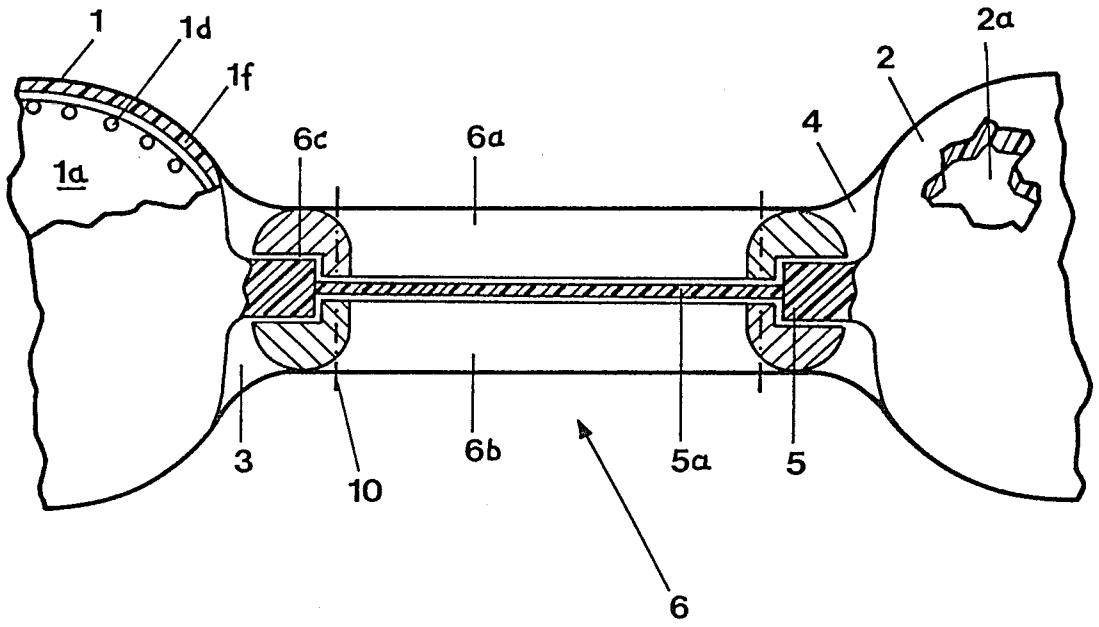
FIG. 4 is a fragmentary view of a detail in the device of FIG. 1, with the coupling member and the annular support for the handle shown in section and with the handle omitted.

The clamping force of the screws 10 which are shown in FIG. 4 is selected in such a way that the support 6 and the handle 7 therein can turn about an axis which extends at right angles to the plane of the substantially flat coupling member 3–5 between any one of an infinite number of different positions. The extent of frictional engagement between the flanges of the annular sections *6a, 6b* on the one hand and the projection *5a* of the web 5 on the other hand can be selected in such a way that the angular position of the support 6 relative to the coupling member 3–5 can be changed only in response to the exertion of a certain force so as to reduce the likelihood of accidental changes in orientation of the coupling member 3–5 and weights 1, 2 relative to the parts 6 and 7.

The chambers *1a, 2a* in the hollow weights 1 and 2 can be filled with a suitable filler material (e.g., water)

upon removal of screw caps or bungs 9, which normally seal openings provided in the respective weights, to afford access to the respective chambers 1*a*, 2*a* as well as to allow for evacuation of material from the respective chambers. Each weight preferably comprises an externally threaded nipple 8 which defines the respective opening and whose external threads can mate with the internal threads of the respective cap 9. Sealing elements in the form of rings, discs and/or others can be inserted between the nipple 8 and the respective cap 9 to reduce the likelihood of leakage. When the screw caps 9 are properly attached to the nipples 8 of the respective weights 1 and 2, they can be said to constitute additional handles or handgrip elements each engageable by a different hand of the user of the exercising device. Thus, the device can be lifted and manipulated by one hand which engages the handle 7 within the confines of the annular support 6, or by two hands each of which grips a different screw cap 9. A foot can be inserted into the opening within the annular support 6 at the one or at the other side of the handle 7. The external surface of the handle 7 is preferably uneven (it can be formed with circumferentially extending ribs and grooves or the like) so as to facilitate manipulation of the improved exercising device. The sole of the foot rests on the handle 7 and the arch of such foot contacts the internal surface of the annular support 6.

Figure 5:
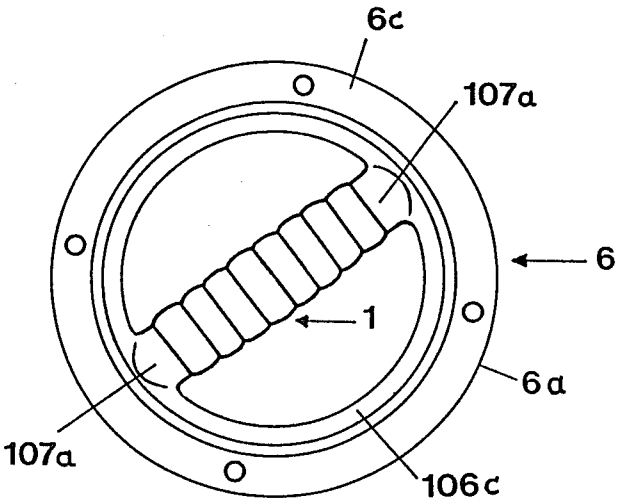
FIG. 5 shows one section of an annular support which is non-rotatably secured to the coupling member and rotatably supports a diametrically extending handle.

If desired, the annular support 6 can be more or less permanently installed in the coupling member 3–5. Such support is then provided with a groove 106*c* FIG. 5 for the end portions 107*a* of the handle 7 which latter is rotatable in the support about an axis preferably coinciding with the axis of the support. The support of FIG. 5 also comprises two annular sections (the section 6*a* is shown) which are clamped to each other and to the rim of the coupling member (not shown in FIG. 5) by several screws or analogous threaded fasteners. Such fasteners can be replaced by clamps or by any other suitable means which can releasably secure the sections of the support to each other and to the coupling member.

The heads of the screws 10 can be provided with diametrically extending slots for simple screwdrivers or with otherwise configurated slots or sockets for screwdrivers with more complex working ends.

The filler material can be used to vary the overall weight of the improved exercising device within a very wide range, e.g., between 1.5 kg and 80 kg. By way of example, the user can decide to fill one or both weights with tap water to thereby increase the overall weight from 1.5 kg to 9 kg or to anywhere within this range. Sand can be used to increase the weight of the device from 1.5 kg up to 14 kg. A mixture of sand and water can be used to vary the weight between 1.5 kg and 19 kg. Fragments of copper slag can be used to increase the weight up to 24 kg and file dust can be admitted into the chambers 1*a*, 2*a* to increase the overall weight up to 40 kg. Small or minute fragments of lead (in the form of balls or the like) can be employed to increase the overall weight up to 80 kg. The above are merely examples because the user can decide to employ other filler materials. Moreover, the improved device can be furnished in many different sizes and shapes each of which can receive a different quantity of filler material.

FIG. 4 shows that the weight 1 comprises a skeleton frame 1*d* of wire mesh or the like and a plastic skin 1*f* which surrounds the frame. The construction of the weight 2 is the same as that of the weight 1.

The improved device can be used for carrying out a practically limitless number of exercises. A single device can be manipulated by one or two hands or by one foot; two devices can be used simultaneously (one by one or both hands and the other by one foot); three devices can be used at the same time (one by each hand and one by a foot or one by both hands and the other two by discrete feet); and it is even possible to use four devices at the same time (one by each hand and one by each foot of a person lying on the floor or on a table). Numerous exercises which can be carried out with the improved device are shown and described in the German-language brochure entitled OMICRON published by KÖLBEL Training Research of German Federal Republic. The device can be used by amateurs and professional athletes, by convalescents as well as by many other persons. For example, the improved device can be used by athletes in connection with the preparation for games of football, tennis, hockey, soccer, baseball, basketball, badminton and many others as well as for participation in biathlon, bobsledding, boxing, weightlifting, rowing, swimming, gymnastics, skating, running, jumping, skiing, jogging weight throwing and numerous other events. The user can employ the device to strengthen her or his legs, arms, back, biceps, triceps, chest muscles, stomach muscles and/or others. The exercise can be supervised by an instructor or it can be carried out at home while the user is standing, sitting or lying down. Moreover, the device can be held between the knees of the user while the user performs a variety of exercises. Still further, the device can be used by an athlete or by another person in a gym or at home while the user sits, stands or lies on a specially designed or standard bench, stool, table or other piece of furniture.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A dumbbell type exercising device comprising two spaced-apart weights at least one of which is hollow; an elongated coupling member disposed between and integral with said weights; a ring installed in and being rotatable relative to said coupling member about an axis which extends transversely of the elongated coupling member; a handle rigid with, surrounded by and extending substantially diametrically of said ring; and means for frictionally holding said ring and said handle against unintentional angular movement relative to said coupling member in any one of an infinite number of different angular positions of the ring and handle with reference to the coupling member.

2. The device of claim 1, wherein said weights and said coupling member together constitute a blow molded one-piece article.

3. The device of claim 1, wherein each of said weights is hollow and defines a chamber, said chambers being sealed from one another by said coupling member.

4. The device of claim 1, wherein said ring has a circumferential groove and said coupling member has a projection extending into said groove.

5. The device of claim 1, wherein said support comprises two annular sections and said coupling member comprises a web which is disposed between said sections, said holding means comprising means for connecting said sections to each other so that the thus connected sections are in frictional engagement with said web.

6. The device of claim 5, wherein said connecting means comprises threaded fasteners.

7. The device of claim 5, wherein said connecting means is adjustable so as to change the friction between said sections and said web, the sections being rotatable relative to said web in at least one first position of adjustment of said connecting means and the sections being held against rotation relative to said web in at least one second position of adjustment of said connecting means.

8. The device of claim 1, wherein said coupling member is substantially flat and said ring is angularly movably mounted in said flat coupling member substantially midway between said weights.

9. The device of claim 1, wherein each of said weights is hollow and defines at least one chamber and an opening communicating with the respective chamber, each of said weights further comprising detachable means for sealing the respective opening.

10. The device of claim 9, further comprising fillers in said chambers to increase the mass of said weights.

11. The device of claim 1, further comprising handgrip elements provided on said weights, each of said weights being disposed between said coupling member and the respective handgrip element.

12. The device of claim 1, wherein at least said one weight comprises a skeleton frame and a plastic wall surrounding said frame.

13. The device of claim 1, wherein said handle has an uneven external surface to facilitate gripping by the hand of the user.

* * * * *